US005277143A

United States Patent [19]

Frangulea

[11] Patent Number: 5,277,143

[45] Date of Patent: Jan. 11, 1994

[54] SHIP HULL REPAIR APPARATUS

[76] Inventor: Gheorghe Frangulea, P.O. Box 9925 Bustleton Ave., Philadelphia, Pa. 19152

[21] Appl. No.: 970,927

[22] Filed: Nov. 2, 1992

[51] Int. Cl.[5] ..... B63B 43/16

[52] U.S. Cl. ..... 114/229; 114/227

[58] Field of Search ..... 114/227, 228, 229

[56] References Cited

U.S. PATENT DOCUMENTS

| | | | |
|---|---|---|---|
| 1,306,938 | 6/1916 | Achiha | 114/229 |
| 2,365,488 | 12/1944 | Nelson | 114/227 |
| 2,446,190 | 8/1948 | Oding | 114/227 |
| 4,329,132 | 5/1982 | Melvoid et al. | 114/227 |
| 4,385,582 | 5/1983 | Fuerst | 114/229 |
| 5,143,012 | 9/1992 | Elkowitz | 114/228 |

FOREIGN PATENT DOCUMENTS

| | | | |
|---|---|---|---|
| 984925 | 1/1983 | U.S.S.R. | 114/227 |
| 1097516 | 6/1984 | U.S.S.R. | 114/227 |

*Primary Examiner*—Michael S. Huppert
*Assistant Examiner*—Thomas J. Brahan
*Attorney, Agent, or Firm*—Leon Gilden

[57] ABSTRACT

A mounting plate includes a pneumatic cylinder arranged in an annular continuous orientation to a first side of the mounting plate, with a pneumatic cylinder having clamping legs, with each clamping leg including a leg claw, and the clamping legs projecting coaxially of the pneumatic chamber, with pneumatic storage cylinders arranged to effect pivoting of the clamping legs to engage an interior surface of a ship's hull, with a further pneumatic storage cylinder arranged to inflate the pneumatic sealing chamber to effect sealing and secure engagement of exterior surface of a ship's hull about a ship hull opening to be repaired.

3 Claims, 4 Drawing Sheets

SHIP HULL REPAIR APPARATUS

BACKGROUND OF THE INVENTION

1. Field of the Invention

The field of invention relates to ship hull repair structure, and more particularly pertains to a new and improved ship hull repair apparatus wherein the same is arranged to engage and sealingly secure a breach in a ship's hull.

2. Description of the Prior Art

Various ship hull repair structure has been utilized in the prior art, wherein U.S. Pat. No. 4,385,582 to Fuerst sets forth an inflatable device arranged to engage a ship's hull for its sealing.

Further examples of sealing structure of ship hull repair is set forth in U.S. Pat. Nos. 3,669,055; 5,009,180; and 4,161,155.

The instant invention attempts to overcome deficiencies of the prior art by providing for a structure of ease of manipulation as well as convenience and effectiveness in construction in a manner not addressed by the prior art permitting its manipulation relative to a ship's hull and its breach for repair and in this respect, the present invention substantially fulfills this need.

SUMMARY OF THE INVENTION

In view of the foregoing disadvantages inherent in the known types of ship repair apparatus now present in the prior art, the present invention provides a ship hull repair apparatus wherein the same is arranged to provide for clamping legs to project through a ship's hull breach to clamp the interior surface thereof, with a sealing ring arranged to engage an exterior surface of the ship's hull about the breach. As such, the general purpose of the present invention, which will be described subsequently in greater detail, is to provide a new and improved ship hull repair apparatus which has all the advantages of the prior art ship hull repair apparatus and none of the disadvantages.

To attain this, the present invention provides a mounting plate including a pneumatic cylinder arranged in an annular continuous orientation to a first side of the mounting plate, with a pneumatic cylinder having clamping legs, with each clamping leg including a leg claw, and the clamping legs projecting coaxially of the pneumatic chamber, with pneumatic storage cylinders arranged to effect pivoting of the clamping legs to engage an interior surface of a ship's hull, with a further pneumatic storage cylinder arranged to inflate the pneumatic sealing chamber to effect sealing and secure engagement of exterior surface of a ship's hull about a ship hull opening to be repaired.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ship hull repair apparatus which has all the advantages of the prior art ship hull repair apparatus and none of the disadvantages.

It is another object of the present invention to provide a new and improved ship hull repair apparatus which may be easily and efficiently manufactured and marketed.

It is a further object of the present invention to provide a new and improved ship hull repair apparatus which is of a durable and reliable construction.

An even further object of the present invention is to provide a new and improved ship hull repair apparatus which is susceptible of a low cost of manufacture with regard to both materials and labor, and which accordingly is then susceptible of low prices of sale to the consuming public, thereby making such ship hull repair apparatus economically available to the buying public.

Still yet another object of the present invention is to provide a new and improved ship hull repair apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 1A:
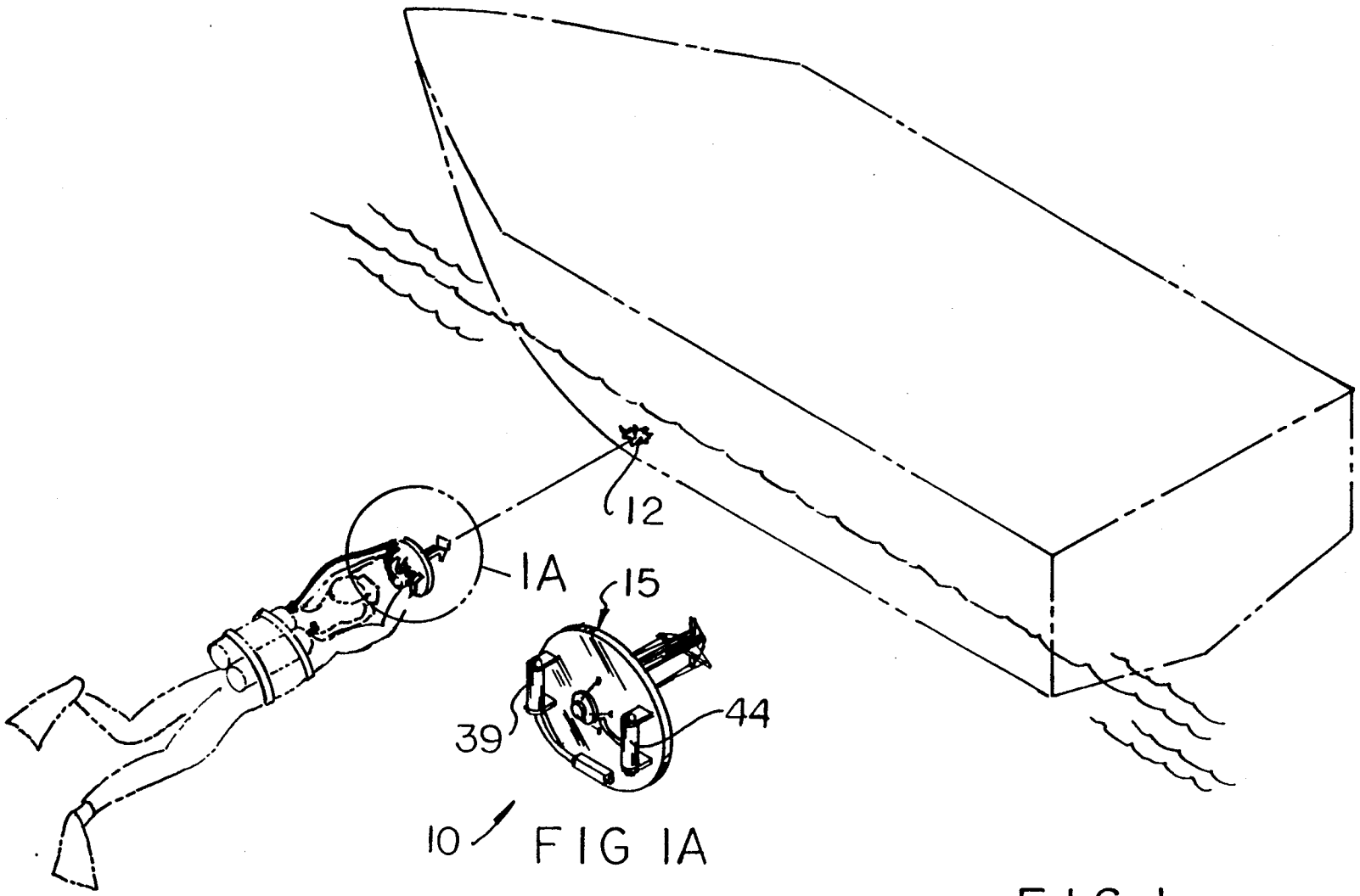
FIG. 1 is an isometric illustration of the invention in use.
FIG. 1*a* is an enlarged isometric illustration of section 1*a* as set forth in FIG. 1.
Figure 2:
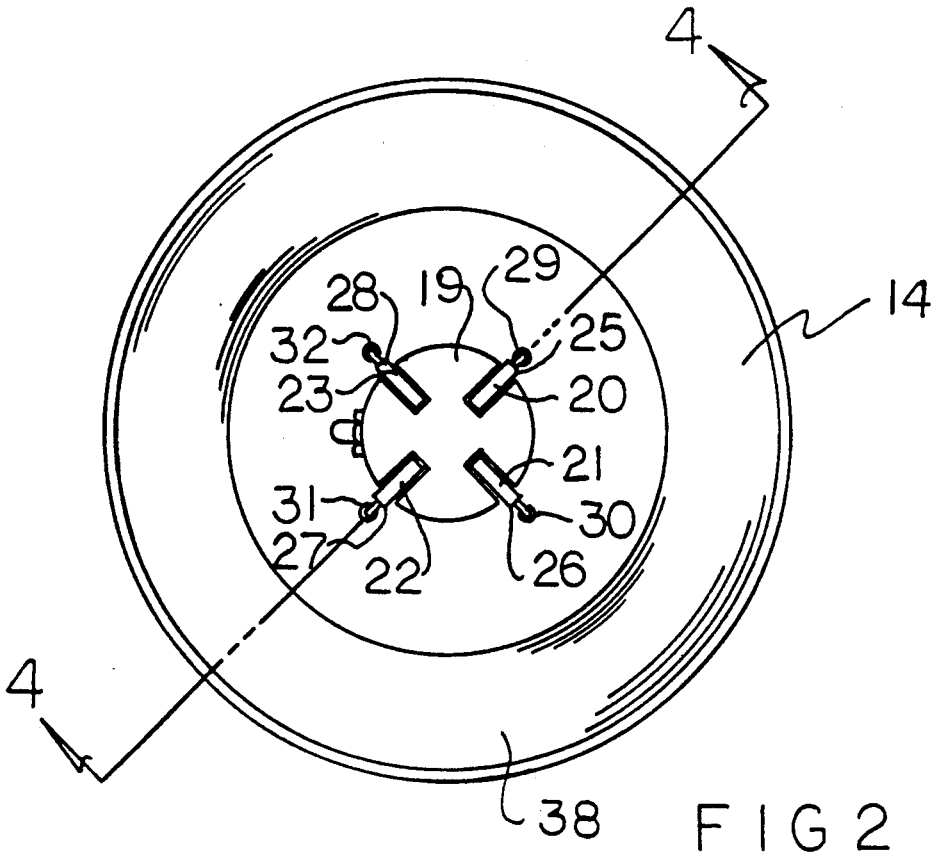
FIG. 2 is an orthographic top view of the structure.
Figure 3:
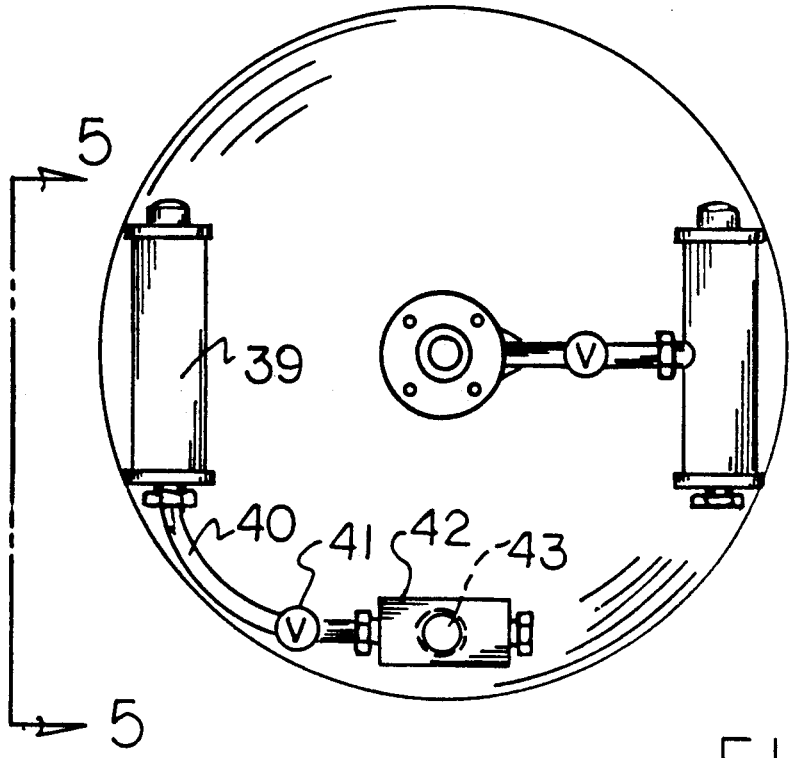
FIG. 3 is an orthographic rear view of the structure.

With reference now to the drawings, and in particular to FIGS. 1 to 7 thereof, a new and improved ship hull repair apparatus embodying the principles and concepts of the present invention and generally designated by the reference numeral 10 will be described.

More specifically, the ship hull repair apparatus 10 of the instant invention essentially comprises the repair of a ship hull opening 11, such as indicated in FIG. 1, by use of the apparatud 10. A mounting plate 13 is provided of rigid construction, having a first side 14 coextensive with a second side 15, and a mounting plate 13 symmetrically oriented about an axis 13*a*. A pneumatic cylinder 16 is fixedly mounted and coaxially aligned relative to the axis 13*a* extending beyond the first and second sides 14 and 15. The pneumatic cylinder includes a cylinder first end 17 projecting beyond the first side 14 and a second end 18 projecting beyond the second side 15. A first end cap 19 is mounted to the first end 17, with the first end cap having respective first, second, third, and fourth elongate clamp legs 20, 21, 22, and 23 respectively pivotally mounted to the first end cap 19, each about an individual pivot axle 24 at a first end of each clamp leg. The second end of each clamp leg terminates in respective first, second, third, and fourth clamp leg claws 25, 26, 27, and 28.

Figure 4:
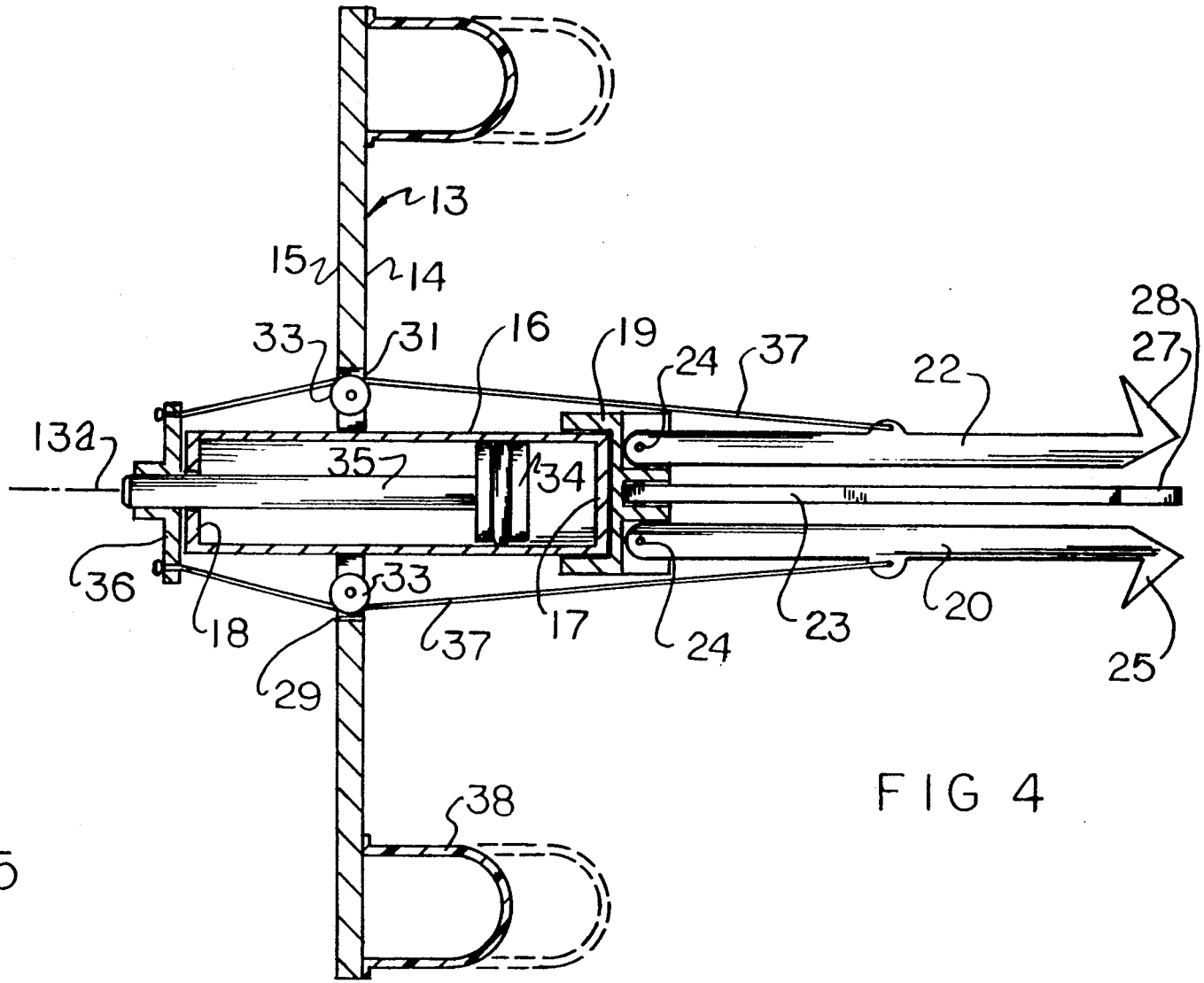
FIG. 4 is an orthographic view, taken along the lines 4—4 of FIG. 2 in the direction indicated by the arrows.
Figure 5:
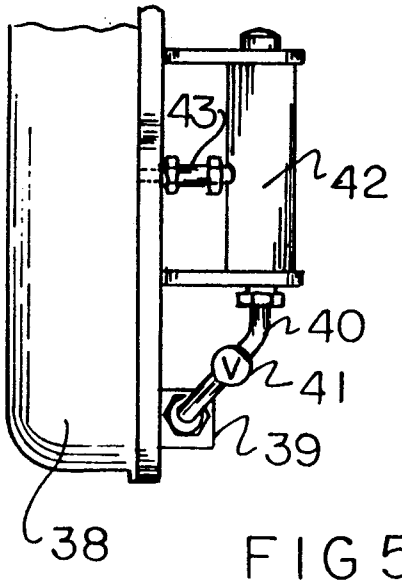
FIG. 5 is an orthographic view, taken along the lines 5—5 of FIG. 3 in the direction indicated by the arrows.
Figure 7:
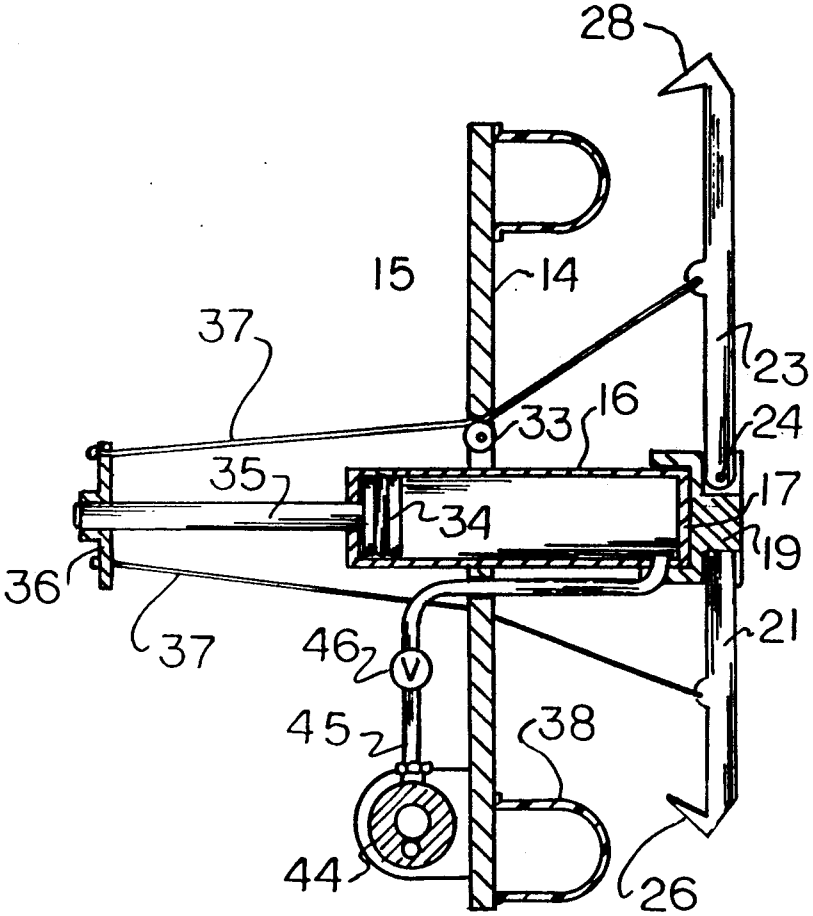
FIG. 7 is an orthographic view, taken along the lines 7—7 of FIG. 6 in the direction indicated by the arrows.
Figure 6:
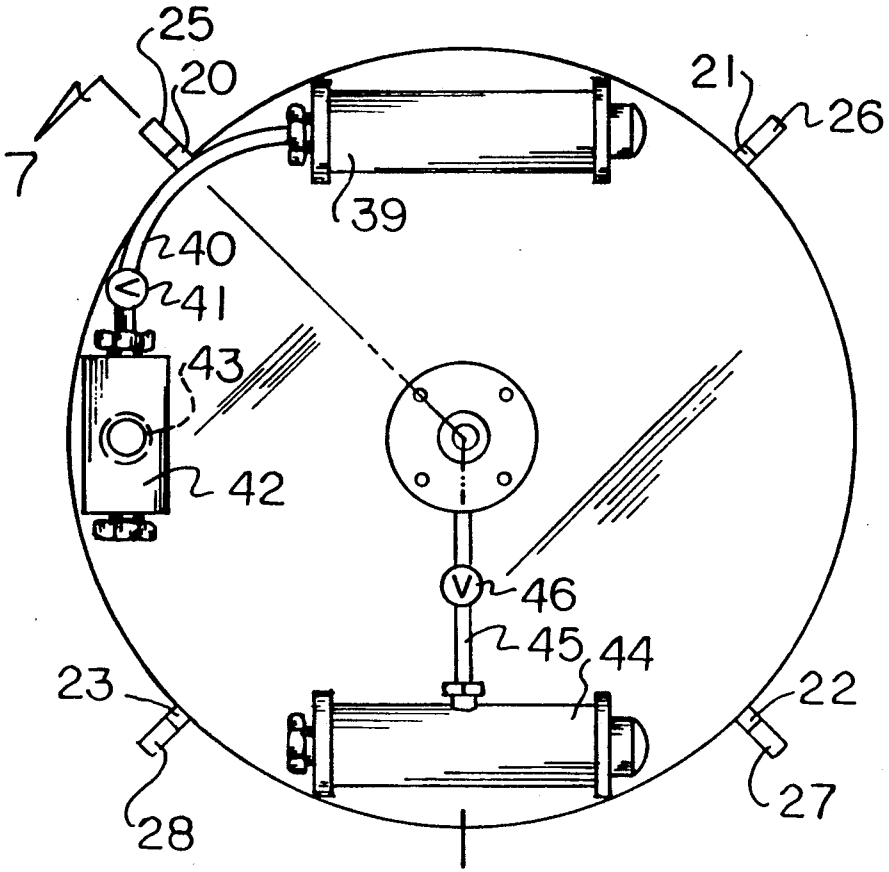
FIG. 6 is an enlarged bottom view of the mounting plate structure of the invention.

Directed through the mounting plate 13 in adjacency to the pneumatic cylinder 16 is a first, second, third, and fourth guide bore 29, 30, 31, and 32 respectively (see FIG. 2), with each guide bore receiving a pull cable 37, with a guide pulley 33 mounted within the mounting plate 13 in adjacency relative to each guide bore to provide for tangle-free guidance of each pull cable when the clamp legs are pivoted from a first orientation substantially parallel to the axis 13*a* to a second orientation substantially orthogonally oriented relative to the axis 13*a* (see FIGS. 4 and 7 respectively).

To effect the pivotal displacement of the clamp legs from the first to the second orientation, a piston 34 is reciprocatably mounted within the pneumatic cylinders 16. A piston rod 35 coaxially aligned with the axis 13*a* is mounted to the piston 34 and projects through the cylinder second end 18 terminating in a rod plate 36 orthogonally and fixedly mounted to the piston rod 35 exteriorly of the pneumatic cylinder 16 adjacent its second end. The piston plate 36 secures a first end of each pull cable 37, with a second end of each pull cable mounted intermediate an individual clamp leg. In this manner, when the piston 34 is directed from a first position to a second position, as indicated in FIGS. 4 and 7, the clamp legs are simultaneously displaced from the first orientation to the second orientation, as indicated in the noted FIGS. 4 and 7.

A pneumatic sealing chamber 38 of continuous and substantially annular configuration is mounted to the first side 14 of the mounting plate 13 adjacent the outer periphery of the mounting plate, with the pneumatic cylinder 16 oriented medially of the substantially annular pneumatic sealing chamber 38. To effect inflation of the pneumatic sealing chamber 38, a first storage cylinder 39 is mounted to the first side 15, having a first conduit 40 directed from the first pneumatic storage cylinder 39 to a first valve 41 permitting selective pneumatic pressure from the storage cylinder 39 through the first valve 41 to a delivery chamber 42. The delivery chamber 42 includes a delivery conduit directed from the delivery chamber 42 through the mounting plate 13 into the pneumatic sealing chamber 38. In this manner, selective opening of the first valve 41 effects selective inflation of the pneumatic sealing chamber 38.

To effect displacement of the piston from the first position to the second position, a second pneumatic storage cylinder 40 is provided and mounted diametrically opposed to the first pneumatic storage cylinder 39 having a second pneumatic conduit 45 including a second valve 46. Opening of the second valve 46 permits selective pneumatic flow from the second pneumatic storage cylinder 44 to the pneumatic cylinder 16 adjacent the pneumatic cylinder's first end 17 to thereby effect displacement of the piston 34 to the second position, as indicated in FIG. 7. The valve structures 41 and 46 may be of any convenient and available construction available commercially and in the prior art.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A ship hull repair apparatus for repairing an opening within a ship hull, wherein the apparatus comprises, a mounting plate, the mounting plate having a first side coextensive with and spaced from a second side, and the mounting plate symmetrically oriented about a mounting plate axis, and the mounting plate having an outer periphery, and a continuous pneumatic sealing chamber mounted to the first side in adjacency to the periphery, and a first pneumatic storage cylinder mounted to the second side, the first pneumatic storage cylinder including a first pneumatic conduit, the first pneumatic conduit directed to and in pneumatic communication with a delivery conduit, the delivery conduit directed through the mounting plate in pneumatic communication with the pneumatic sealing chamber, and a valve member mounted within the first conduit for effecting selective pneumatic flow from the first pneumatic storage cylinder for selective inflation of the pneumatic sealing chamber, and a pneumatic cylinder fixedly mounted through the mounting plate orthogonally oriented relative to the first side and the second side and symmetrically about the axis, with the pneumatic cylinder having a cylinder first end oriented beyond the first side, and a cylinder second end oriented beyond the second side, with a first end cap fixedly mounted to the cylinder first end, with the first end cap having a plurality of elongate clamp legs, with each clamp leg having a clamp leg first end, and each clamp leg first end having a pivot axle pivotally mounting each respective clamp leg to the first end cap, and each clamp leg having a clamp leg second end, with each clamp leg second end terminating in a leg claw obliquely oriented relative to said respective clamp leg, and said plurality of clamp legs equalling a predetermined number, and a plurality of guide bores equal to said predetermined number, and each guide bore having a guide pulley, and the pneumatic cylinder including a piston reciprocatably mounted therewithin, the piston including a piston rod, the piston rod projecting through the cylinder second end aligned with the axis, and the cylinder second end including a rod plate, and each clamp leg having a pull cable extending from said each clamp leg through one of said guide bores in cooperation with one of said guide pulleys, and the pull cable having a pull cable first end mounted to the rod plate, and each pull cable having a pull cable second end mounted to one of said clamp legs intermediate said one of said clamp legs, and drive means for effecting reciprocation of said piston from a first position adjacent the cylinder first end to a second position adjacent the cylinder second end for simultaneous pivoting of each clamp leg from a first position substantially parallel to the axis to a second position substantially orthogonally oriented relative to the axis.

2. An apparatus as set forth in claim 1 wherein the drive means includes a second pneumatic storage cylinder mounted to the second side, with the second pneumatic storage cylinder having a second pneumatic conduit directed through the mounting plate, and the second pneumatic conduit having a second valve for effecting selective pneumatic air flow therethrough, and the second pneumatic conduit directed into the pneumatic cylinder in adjacency to the first end.

3. An apparatus as set forth in claim 2 wherein the first pneumatic storage cylinder and the second pneumatic storage cylinder are diametrically opposed relative to one another on the second side to provide for manual grasping of the first pneumatic storage cylinder and the second pneumatic storage cylinder for ease of manipulation of the mounting plate relative to the ship hull opening.

* * * * *